US009302194B2

(12) United States Patent
Hsu et al.

(10) Patent No.: US 9,302,194 B2
(45) Date of Patent: Apr. 5, 2016

(54) DETACHABLE HULA HOOP HAVING WATERPROOF RESERVOIRS

(71) Applicants: Cheng-Hsiung Hsu, Lukang Township, Changhua County (TW); Su-Chen Li, Lukang Township, Changhua County (TW)

(72) Inventors: Cheng-Hsiung Hsu, Lukang Township, Changhua County (TW); Su-Chen Li, Lukang Township, Changhua County (TW)

( * ) Notice: Subject to any disclaimer, the term of this patent is extended or adjusted under 35 U.S.C. 154(b) by 0 days.

(21) Appl. No.: 14/738,826

(22) Filed: Jun. 12, 2015

(65) Prior Publication Data

US 2016/0016093 A1 Jan. 21, 2016

(30) Foreign Application Priority Data

Jul. 16, 2014 (TW) ..... 103212644

(51) Int. Cl.
*A63H 33/02* (2006.01)
*A63H 33/00* (2006.01)
*A63B 19/00* (2006.01)

(52) U.S. Cl.
CPC ..... *A63H 33/00* (2013.01); *A63B 19/00* (2013.01)

(58) Field of Classification Search
USPC ..... 446/236, 242, 265, 266, 297, 484, 485
See application file for complete search history.

(56) References Cited

U.S. PATENT DOCUMENTS

| | | | | |
|---|---|---|---|---|
| 4,380,885 | A * | 4/1983 | Komagata | A63B 19/00 403/383 |
| 4,915,666 | A * | 4/1990 | Maleyko | A63B 19/00 446/242 |
| 5,338,244 | A * | 8/1994 | Huang | A63B 19/00 446/236 |
| 6,319,086 | B1 * | 11/2001 | Shen | A63B 19/00 446/236 |
| 6,497,603 | B1 * | 12/2002 | Magers | A63B 19/00 446/236 |
| 7,780,501 | B2 * | 8/2010 | Kim | A63B 19/00 446/236 |

* cited by examiner

*Primary Examiner* — Nini Legesse
(74) *Attorney, Agent, or Firm* — Cheng-Ju Chiang

(57) ABSTRACT

A detachable hula hoop having waterproof reservoirs is provided with hollow arc sections each including a neck; a first connection end at a first end and including an opening, a channel, and a first recess on a surface; a plug including a cylindrical member and a head; a second connection end at a second end and including a closed member and a second recess on a surface; and a reservoir. The first recess is complimentarily disposed in the second recess to fasten the first and second connection ends together. The cylindrical member is disposed in the neck, the head urges against an annular shoulder to block the neck, and the head is urged against by the closed member.

8 Claims, 7 Drawing Sheets

DETACHABLE HULA HOOP HAVING WATERPROOF RESERVOIRS

BACKGROUND OF THE INVENTION

1. Field of the Invention

The invention relates to hula hoops and more particularly to a detachable hula hoop including hollow, ready to assemble arc sections having a reservoir, a desired quantity of liquid being adapted to fill in the reservoir so that weight of the hula hoop can be adjusted, and the reservoir can be made waterproof by inserting a plug into one end opening of the reservoir.

2. Description of Related Art

A portion of a conventional detachable hula hoop is shown in FIGS. 6A, 6B, 7A, and 7B. The hula hoop comprises a plurality of arc sections 20 each including a first connection end 21 having an opening 211, a peripheral first surface 212, and a first recess 214 on the first surface 212; and a second connection end 22 having a closed member 221, a peripheral second surface 222, and a second recess 223 on the second surface 222. The second connection end 22 can be inserted into the first connection end 21 with the first recess 214 complimentarily disposed in the second recess 223 to fasten the first and second connection ends 21, 22 together. A complete hula hoop can be assembled by following above insertion method.

While the hula hoop is can be easy assembled or disassembled, it has a light weight because it is made of tubular plastic. Thus, the desired purpose of exercising the waist cannot be obtained. Thus, the need for improvement still exists.

SUMMARY OF THE INVENTION

The object of the invention is to provide a hula hoop having waterproof reservoirs with the advantages listed as follows. It is waterproof. The occupied space of the disassembled hula hoop is greatly decreased for ease of storage and delivery. The hula hoop can be used immediately after being bought by a customer if the reservoirs are filled with liquid. To the contrary, empty reservoirs can decrease weight of the hula hoop in the delivery. The weight of the hula hoop can be adjusted as desired by filling a desired quantity of liquid in the reservoirs. This invention comprising:

a plurality of hollow arc sections each comprising:

- a first connection end including an opening, a first peripheral surface, an axial channel, and a first recess formed on the first peripheral surface;
- a second connection end including a closed member, a second peripheral surface, and a second recess formed on the second peripheral surface wherein the closed member is disposed in the channel, and the first recess is complimentarily disposed in the second recess to fasten the first and second connection ends together;
- an annular neck adjacent to the first connection end and having a diameter less than that of the arc section, the neck including an inner surface and at least one annular shoulder;
- a plug including a cylindrical member having a diameter substantially equal to an inner diameter of the inner surface, and a head;
- a reservoir formed in the arc section and between the first connection end and the second connection for containing a quantity of liquid;

wherein the liquid is able to be poured into the reservoir through the opening, the cylindrical member is configured to dispose in the inner surface, the head is configured to urge against one of the at least one annular shoulder to block the neck, so as to form the hula hoop having waterproof reservoirs by assembling the arc sections.

The above and other objects, features and advantages of the invention will become apparent from the following detailed description taken with the accompanying drawings.

DETAILED DESCRIPTION OF THE INVENTION

Figure 1A:
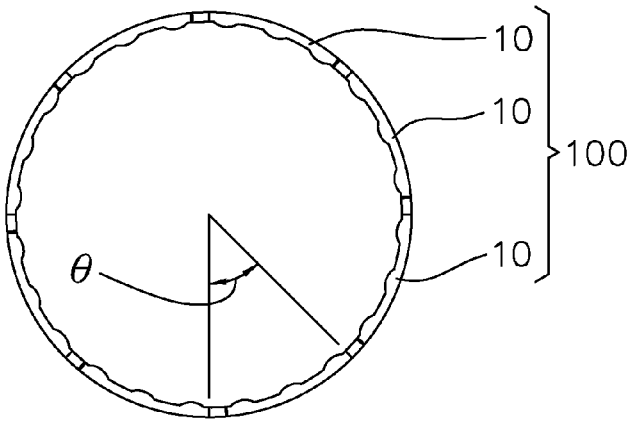
FIG. 1A is a side elevation of a detachable hula hoop having waterproof reservoirs according to the invention.
Figure 1B:
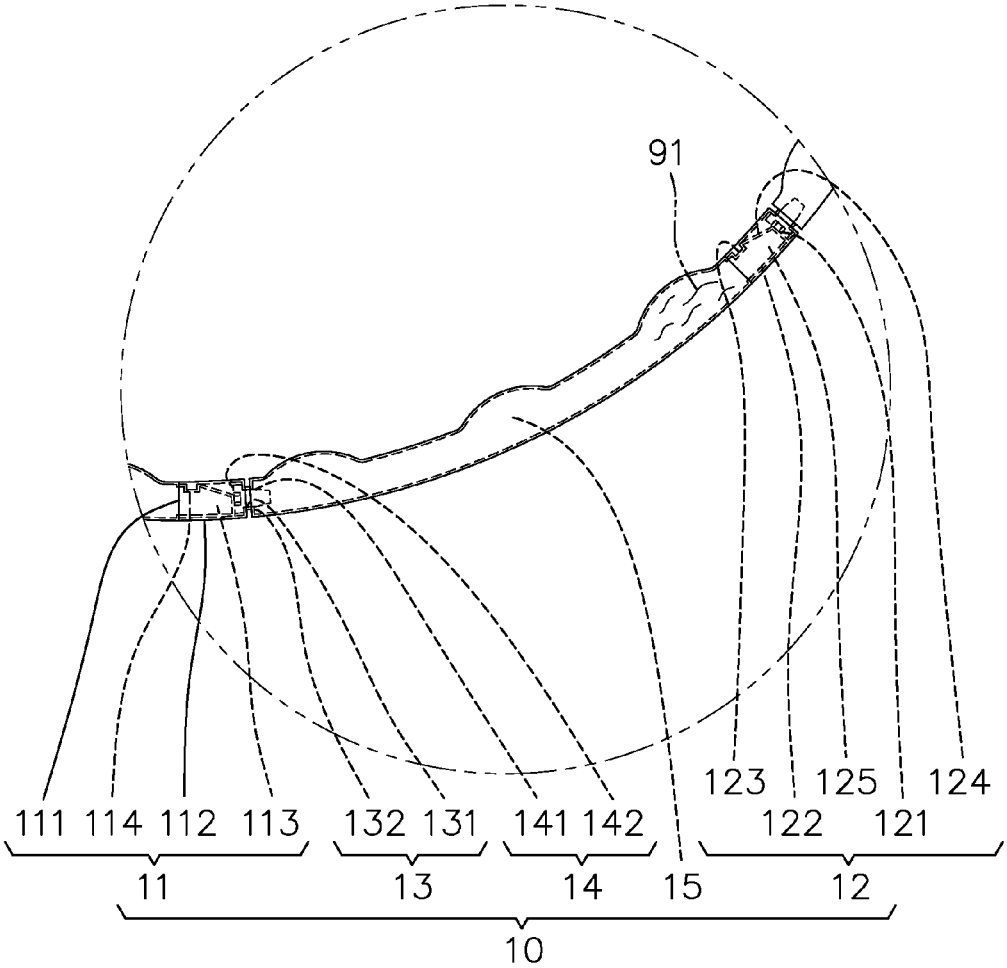
FIG. 1B is a detailed view of circled portion of FIG. 1A.
Figure 2:
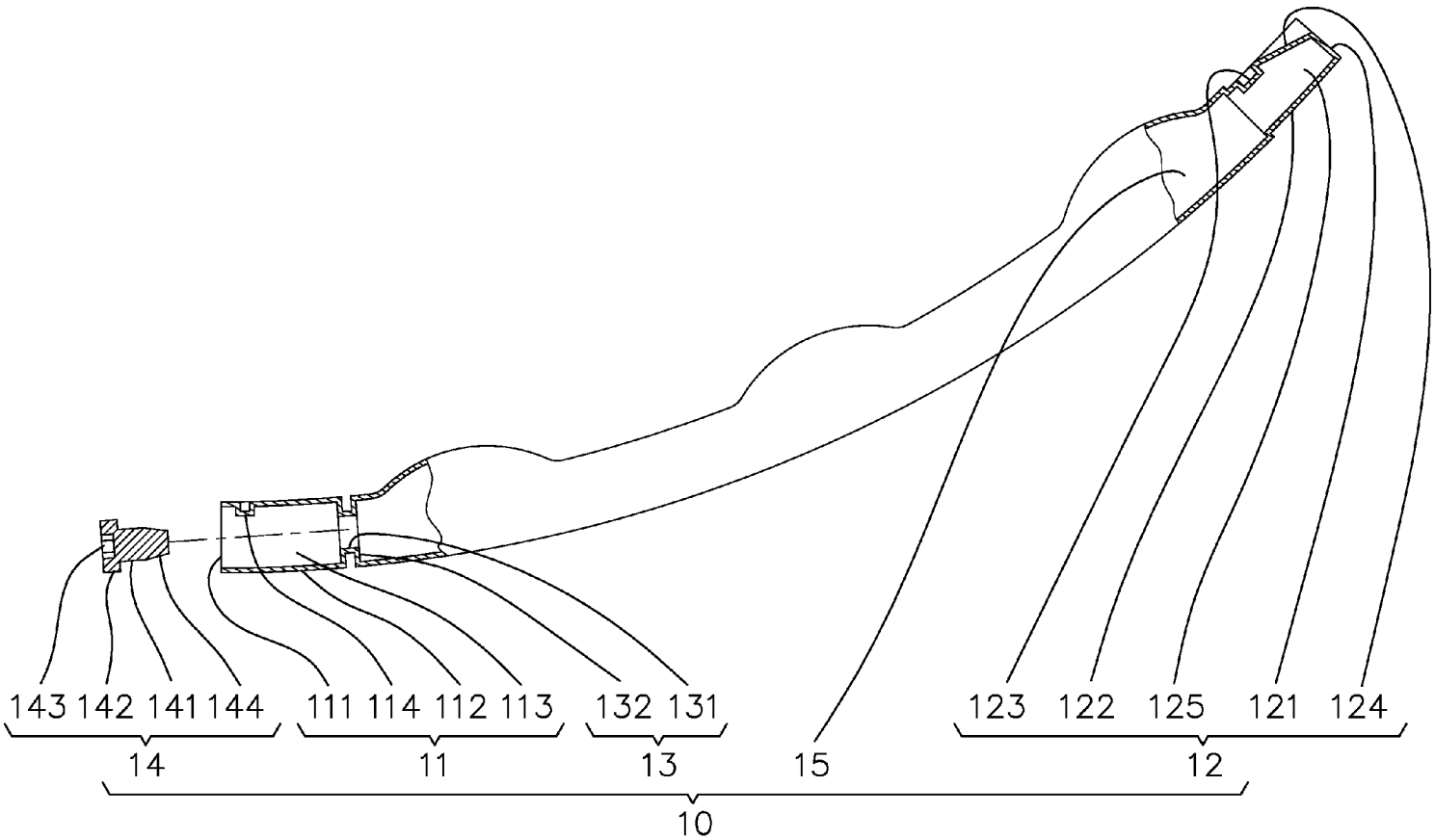
FIG. 2 is an enlarged view in part section of FIG. 1B.
Figure 3:
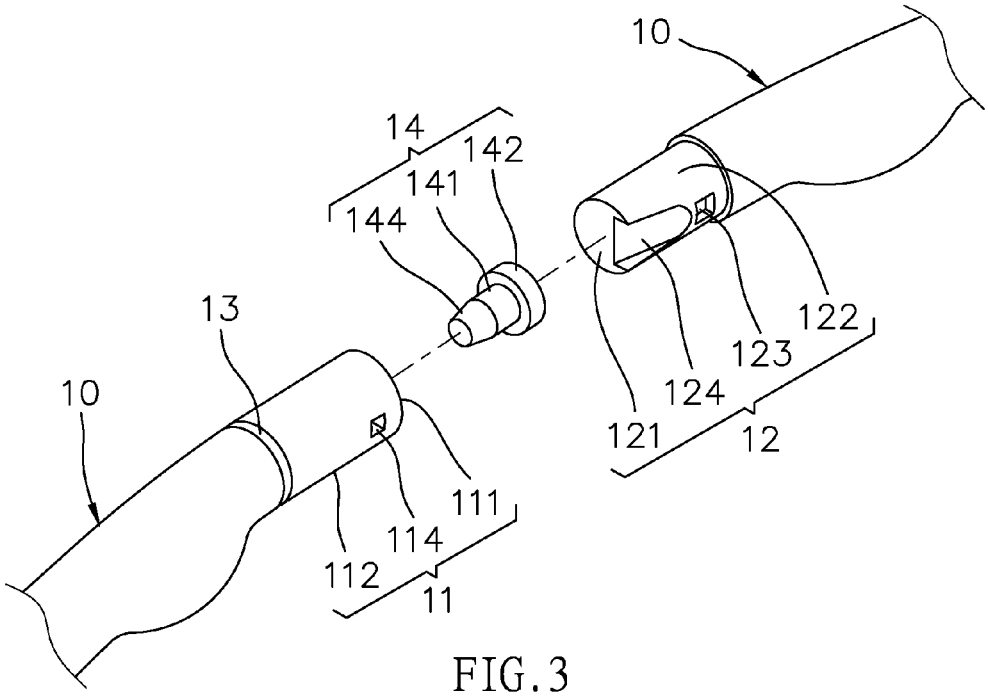
FIG. 3 is a perspective view of portions of two arc sections of the hula hoop and the arc section to be assembled.
Figure 4A:
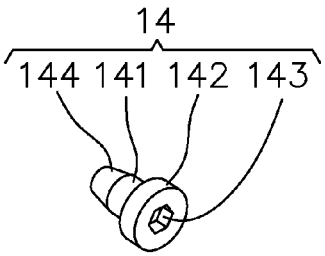
FIG. 4A is a perspective view of the plug.
Figure 4B:
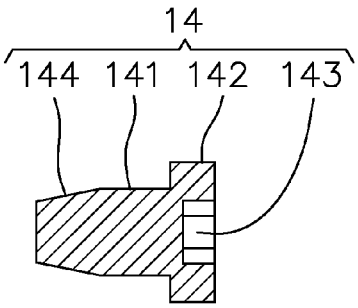
FIG. 4B is a sectional view of the plug.
Figure 5A:
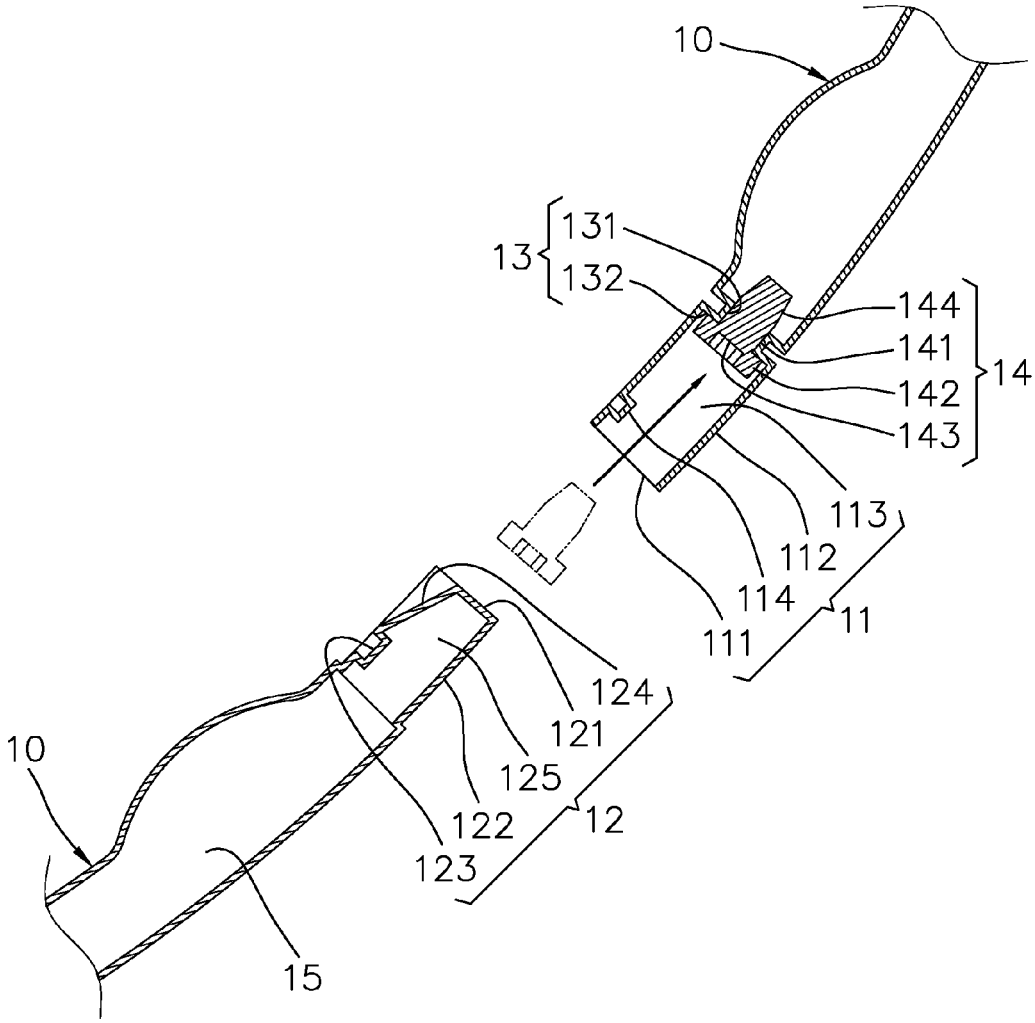
FIG. 5A is a sectional view of FIG. 3.
Figure 5B:
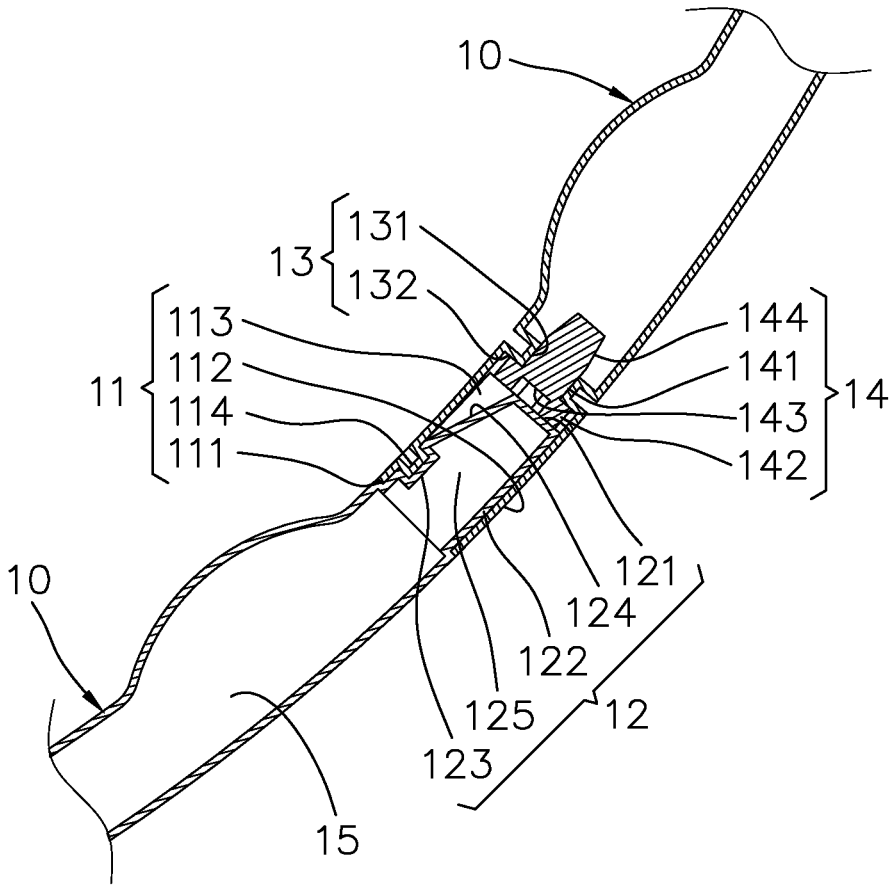
FIG. 5B is a view similar to FIG. 5A showing the assembled arc sections and the plug.
Figure 6A:
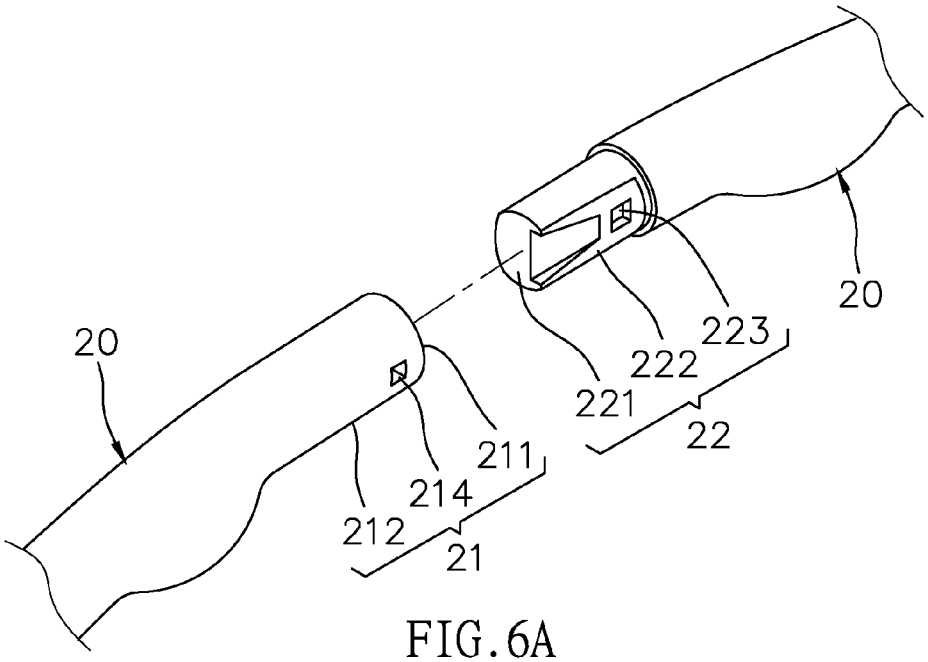
FIG.6A (PRIOR ART)
FIG. 6A is a perspective view of portions of two arc sections of a conventional detachable hula hoop to be assembled.
Figure 6B:
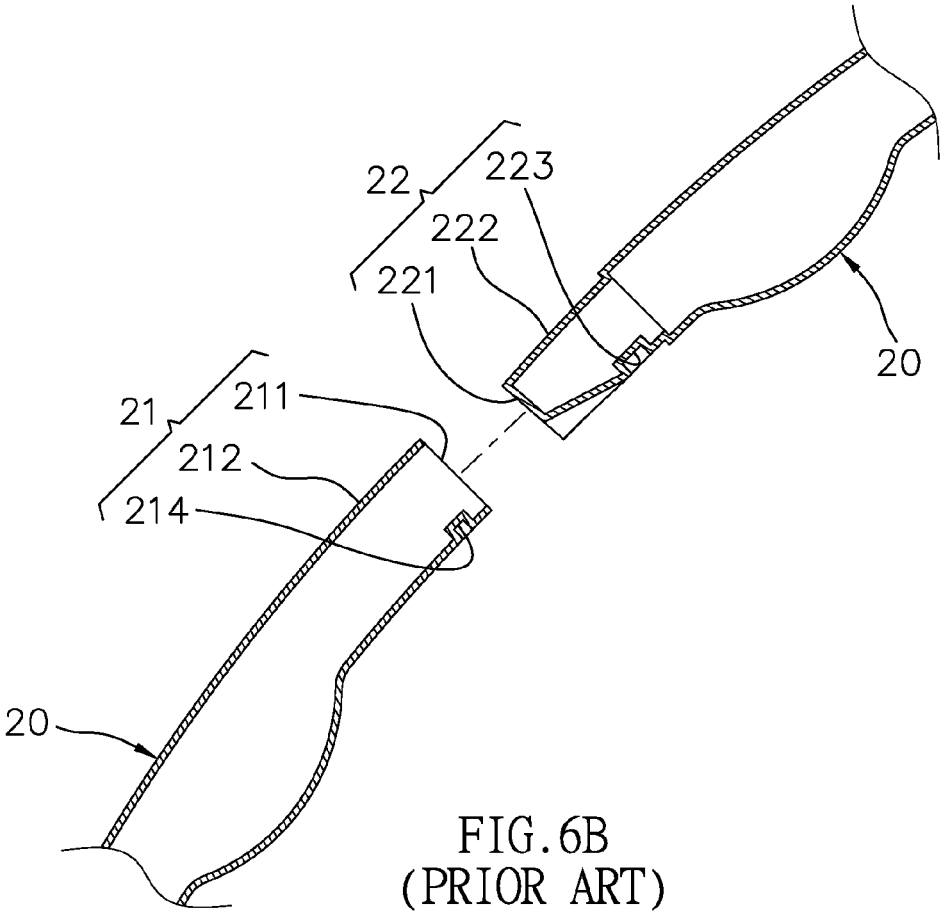
FIG.6B (PRIOR ART)
FIG. 6B is a sectional view of FIG. 6A.
Figure 7A:
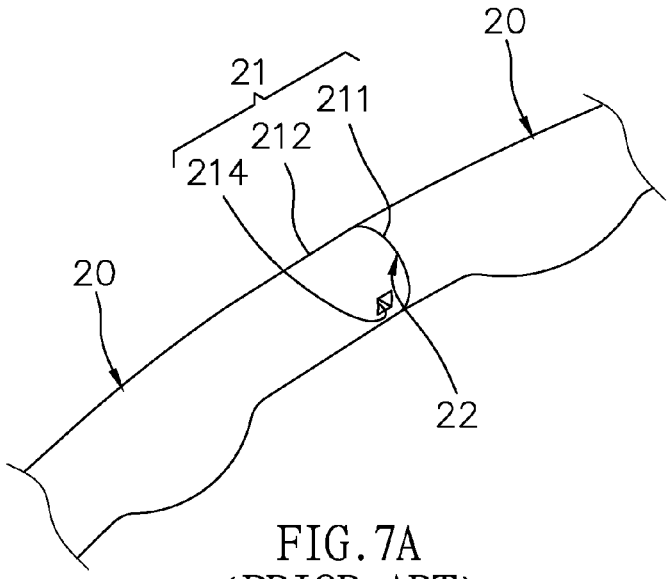
FIG. 7A (PRIOR ART)
FIG. 7A is a perspective view of the assembled arc sections of FIG. 6A.
Figure 7B:
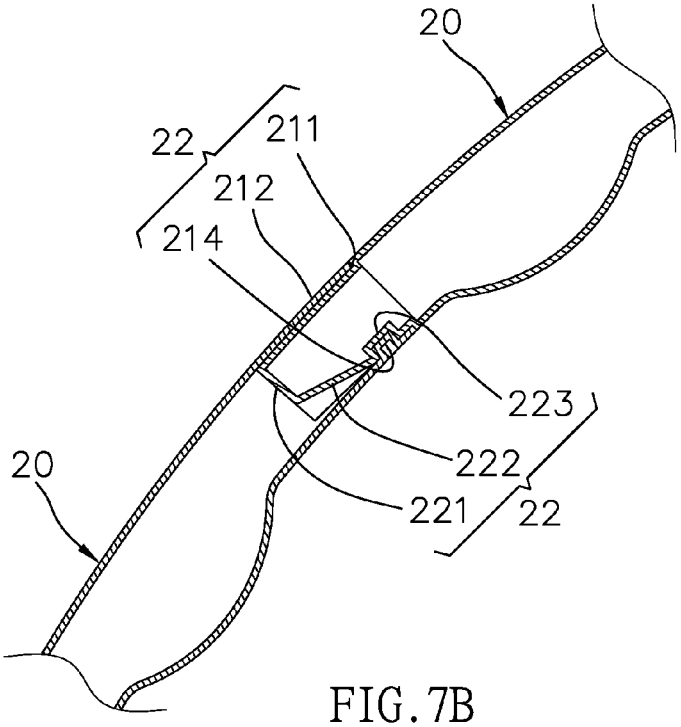
FIG. 7B (PRIOR ART)
FIG. 7B is a sectional view of FIG. 7A.

Referring to FIGS. 1A, 1B, 2, 3, 4A, 4B, 5A and 5B, a detachable hula hoop having waterproof reservoirs 100 in accordance with the invention comprises the following components as discussed in detail below.

The detachable hula hoop having waterproof reservoirs 100 includes a plurality of hollow arc sections 10. Each hollow arc section 10 comprises a first connection end 11, a second connection end 12, an annular neck 13, a plug 14, and a reservoir 15.

With regard to the first connection end 11, it has an opening 111, a first peripheral surface 112, an axial channel 113, and a first recess 114 formed on the first peripheral surface 112.

The second connection end 12 has a closed member 121, a second peripheral surface 122, a second recess 123 formed on the second peripheral surface 122, an inclined surface 124 formed between the second recess 123 and an end of the closed member 121, and an interior space 125 in the closed member 121. The interior space 125 communicates with the reservoir 15 formed in the main portion of the arc section 10 so that liquid (or water) 91 stored in the reservoir 15 can flow to the space 125.

Concerning the annular neck 13, it is adjacent to the first connection end 11 and having a diameter less than that of the arc section 10. It interconnects the first connection end 11 and the main portion of the arc section 10. The neck 13 includes an inner surface 131 and two annular shoulders 132 each formed either between the neck 13 and the first connection end 11 or between the neck 13 and the main portion of the arc section 10.

About the plug 14, it includes a cylindrical member 141 having a diameter substantially equal to an inner diameter of the neck 13, an enlarged head 142, a hexagonal socket 143 in the head 142, and a guide 144 forwardly of the cylindrical member 141, the guide 144 being tapered toward its forward end.

The reservoir 15 is formed in the main portion of the arc section 10 and between the first connection end 11 and the second connection end 12 for containing a quantity of liquid.

Therefore, the liquid is able to be poured into the reservoir 15 through the opening 111. The cylindrical member 141 is configured to dispose in the inner surface 131. The head 142 is configured to urge against one of the at least one annular shoulder 132 to block the neck 13, so as to form the hula hoop having waterproof reservoirs by assembling the arc sections 10.

As shown in FIG. 1A, there are eight arc sections 10 and the measure of the plug 10 is 45 degrees (i.e., 360 divided by 8).

Assembly of the hula hoop having waterproof reservoirs 100 is described in detail below. A user may pour liquid 91 into the reservoir 15 through the opening 111. Next, the user may insert the head of a tool (e.g., hex key (not shown)) into the socket 143. Then the user may rotate the tool to drive the plug 14 until the head 142 is stopped by the shoulder 132. The provision of the guide 144 having a tapered end facilitates the insertion of the plug 14 through the neck 13 into the arc section 10. Thus, the neck 13 is blocked by the plug 14 and liquid 91 is not allowed to flow from the reservoir 15 to the channel 113 (i.e., being waterproof).

Further, the second connection end 12 can be inserted into the first connection end 11 with the first recess 114 complimentarily disposed in the second recess 123 to fasten the first and second connection ends 11, 12 together. Further, the head 142 is urged against by the closed member 121. The provision of the inclined surface 124 facilitates the insertion of the second connection end 12 into the first connection end 11. A complete hula hoop having waterproof reservoirs 100 can be assembled by following above method.

It is noted that removal of the plug 14 can be done by using the tool (e.g., hex key) in a manner known in the art.

The advantages and functions of this invention are listed as follows. First, it is waterproof. This is because the plug is fastened in the neck very tightly. Further, the plug head is urged against by the closed member of the second connection end attached to the first connection end. Second, it is detachable and is for easy disassembly. The occupied space of the disassembled hula hoop is greatly decreased for ease of storage and delivery. Third, liquid can be stored in the reservoirs or not depending on demand after leaving the factory. The hula hoop can be used immediately after being bought by a customer if the reservoirs are filled with liquid. To the contrary, empty reservoirs can decrease weight of the hula hoop in the delivery. Fourth, weight of the hula hoop can be adjusted as desired by filling a desired quantity of liquid in the reservoirs.

While the invention has been described in terms of preferred embodiments, those skilled in the art will recognize that the invention can be practiced with modifications within the spirit and scope of the appended claims.

What is claimed is:

1. A hula hoop having waterproof reservoirs comprising:

a plurality of hollow arc sections each comprising:

a first connection end including an opening, a first peripheral surface, an axial channel, and a first recess formed on said first peripheral surface;

a second connection end including a closed member, a second peripheral surface, and a second recess formed on said second peripheral surface wherein the closed member is disposed in said channel, and said first recess is complimentarily disposed in said second recess to fasten said first and second connection ends together;

an annular neck adjacent to said first connection end and having a diameter less than that of said arc section, said neck including an inner surface and at least one annular shoulder;

a plug including a cylindrical member having a diameter substantially equal to an inner diameter of said inner surface, and a head; and a reservoir formed in said arc section and between said first connection end and said second connection for containing a quantity of liquid;

wherein the liquid is able to be poured into the reservoir through the opening, the cylindrical member is configured to dispose in the inner surface, the head is configured to urge against one of the at least one annular shoulder to block the neck, so as to form said hula hoop having waterproof reservoirs by assembling said arc sections.

2. The hula hoop having waterproof reservoirs of claim 1, wherein the second connection end further comprises a guide surface formed between the second recess and the closed member for guiding the first recess to complimentarily dispose in the second recess.

3. The hula hoop having waterproof reservoirs of claim 2, wherein the guide surface is inclined.

4. The hula hoop having waterproof reservoirs of claim 1, wherein the second connection end further comprises an interior space formed in the closed member, the interior space communicating with the reservoir so that the liquid in the reservoir is configured to flow to the interior space.

5. The hula hoop having waterproof reservoirs of claim 4, wherein the liquid is water.

6. The hula hoop having waterproof reservoirs of claim 1, wherein the plug further comprises a socket formed in the head for driving the cylindrical member through the at least one annular shoulder.

7. The hula hoop having waterproof reservoirs of claim 6, wherein the socket is a hexagonal socket.

8. The hula hoop having waterproof reservoirs of claim 1, wherein the plug further comprises a guide disposed forwardly of the cylindrical member, the guide being tapered toward its forward end for facilitating the insertion of the cylindrical member through the at least one annular shoulder.

* * * * *